US007121962B2

(12) United States Patent
Reeves

(10) Patent No.: US 7,121,962 B2
(45) Date of Patent: Oct. 17, 2006

(54) GOLF ROUND DATA SYSTEM WITH CELLULAR TELEPHONE AND PLAYER HELP FEATURES

(76) Inventor: G. George Reeves, 3324 Octavia St., Raleigh, NC (US) 27606

( * ) Notice: Subject to any disclaimer, the term of this patent is extended or adjusted under 35 U.S.C. 154(b) by 0 days.

(21) Appl. No.: 09/739,503

(22) Filed: Dec. 19, 2000

(65) Prior Publication Data

US 2004/0073325 A1 Apr. 15, 2004

(51) Int. Cl.
*A63B 57/00* (2006.01)
*A63B 53/00* (2006.01)

(52) U.S. Cl. ..... 473/407; 463/41

(58) Field of Classification Search ..... 463/1, 463/39–43; 273/317.2, 108.2; 700/90–93; 473/409, 404, 407, 131; 342/357.13; 701/213
See application file for complete search history.

(56) References Cited

U.S. PATENT DOCUMENTS 4,367,526 A * 1/1983 McGeary et al. ..... 364/411
4,864,592 A * 9/1989 Lee ..... 377/5
4,910,677 A * 3/1990 Remedio et al. ..... 364/410
5,095,430 A * 3/1992 Bonito et al. ..... 364/410
5,127,044 A * 6/1992 Bonito et al. ..... 379/88
5,245,537 A * 9/1993 Barber ..... 364/410
5,283,733 A * 2/1994 Colley ..... 364/411
5,319,548 A * 6/1994 Germain ..... 364/410
5,434,789 A * 7/1995 Fraker et al. ..... 364/460
5,471,191 A * 11/1995 Narita ..... 340/232 R
5,504,312 A * 4/1996 Morrison et al. ..... 235/375
5,507,485 A * 4/1996 Fisher ..... 273/32 R
5,513,854 A * 5/1996 Daver ..... 273/454
5,558,333 A * 9/1996 Kelson et al. ..... 473/131
5,562,550 A * 10/1996 Chartrand ..... 473/131
5,582,566 A * 12/1996 Imasaka et al. ..... 473/407
5,591,088 A * 1/1997 Bianco et al. ..... 473/131
5,658,210 A * 8/1997 Cornell ..... 473/407
5,664,880 A * 9/1997 Johnson et al. ..... 364/410
5,681,108 A * 10/1997 Miller ..... 364/411
5,691,922 A * 11/1997 McEwan et al. ..... 364/561
5,740,077 A * 4/1998 Reeves ..... 364/561
5,779,549 A * 7/1998 Walker et al. ..... 463/42
5,779,566 A * 7/1998 Wilens ..... 473/407
5,949,679 A * 9/1999 Born et al. ..... 364/410.1
RE36,346 E * 10/1999 Germain ..... 364/411.1
6,030,109 A * 2/2000 Lobsenz ..... 364/411.1
6,062,991 A * 5/2000 Moriarty et al. ..... 473/407
6,074,312 A * 6/2000 Lyon et al. ..... 473/409
6,089,459 A * 7/2000 Eisele et al. ..... 235/492
6,111,541 A * 8/2000 Karmel ..... 342/357.13
6,171,199 B1 * 1/2001 Cohodas et al. ..... 473/131

(Continued)

*Primary Examiner*—Scott Jones
(74) *Attorney, Agent, or Firm*—Coats & Bennett, P.L.L.C.

(57) ABSTRACT

A portable handheld device for collecting and displaying golf round data. The data collected for each stroke includes the location, time and club used and the resulting ball position achieved. Locations on the golf course are determined by radiolocation. Data transfers between the handheld device and external storage are by direct connection or cellular telephone or some other wireless link. Before each drive or approach shot, player performance and course distance information are used to help the player choose the correct club. Putt break prediction is provided before putting strokes. Information that a stroke has been taken and which club was used can be entered manually by the player or sensed automatically from telemetry equipped golf clubs. Golf round data collected is used to produce play souvenirs, records and analyses. Any selected stroke in a round can also be replayed on a graphical display of the handheld device.

78 Claims, 5 Drawing Sheets

Figure 1:
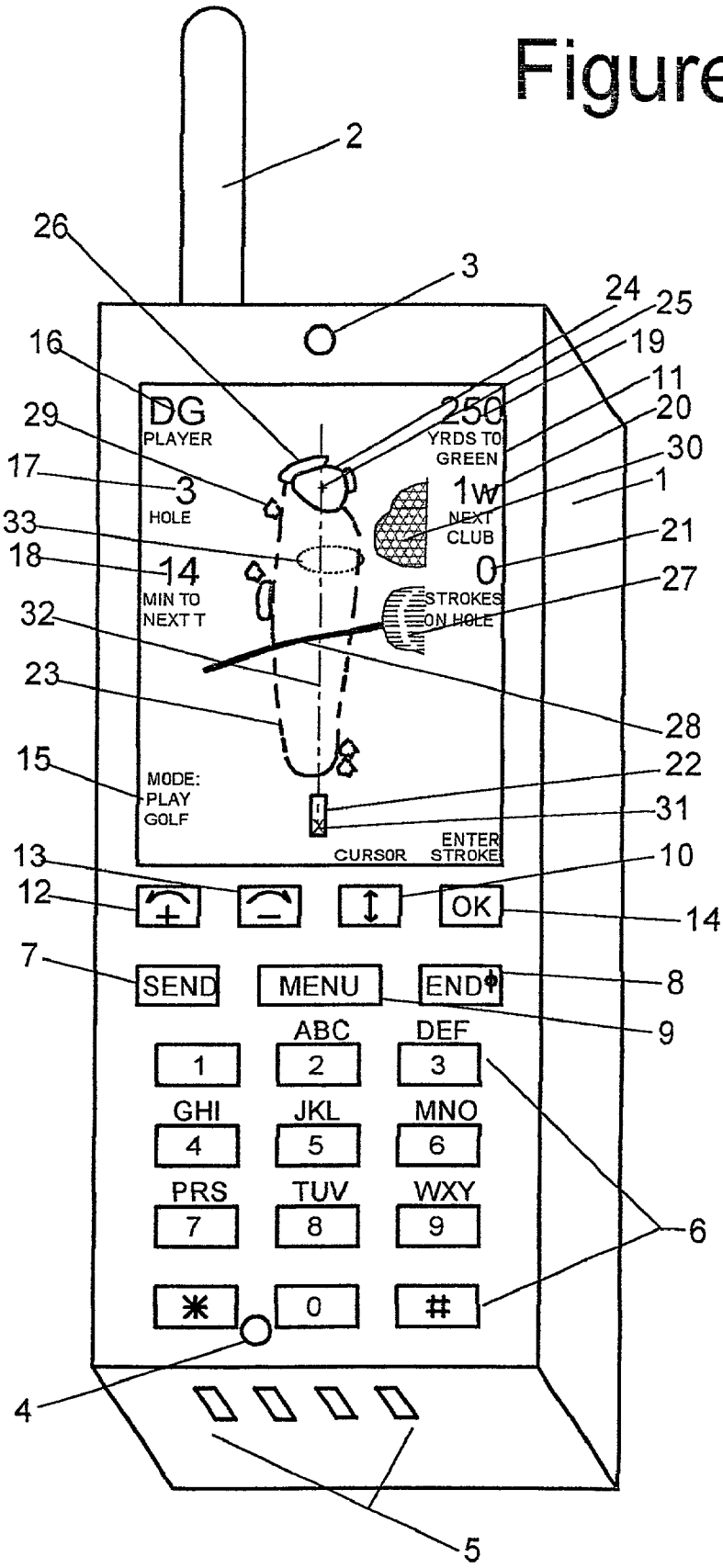

U.S. PATENT DOCUMENTS 6,227,973 B1 * 5/2001 Kikuchi ..... 463/31
6,246,917 B1 * 6/2001 Smith et al. ..... 700/92
6,275,774 B1 * 8/2001 Baron, Sr. et al. ..... 702/3
6,277,029 B1 * 8/2001 Hanley, Jr. ..... 473/131
6,282,362 B1 * 8/2001 Murphy et al. ..... 386/46
6,296,579 B1 * 10/2001 Robinson ..... 473/407

* cited by examiner 2
26
3
24
25
19
11
20
30
1
16
29
17
33
18
32
23
15
13
12
7
DG
PLAYER
3
HOLE
14
MIN TO
NEXT T
MODE:
PLAY
GOLF
250
YRDS TO
GREEN
1W
NEXT
CLUB
0
STROKES
ON HOLE
CURSOR
ENTER
STROKE
21
27
28
22
31
10
14
OK
SEND
MENU
END
8
9
ABC
DEF
1
2
3
GHI
JKL
MNO
4
5
6
PRS
TUV
WXY
7
8
9
*
0

6
4
5

Figure 3a
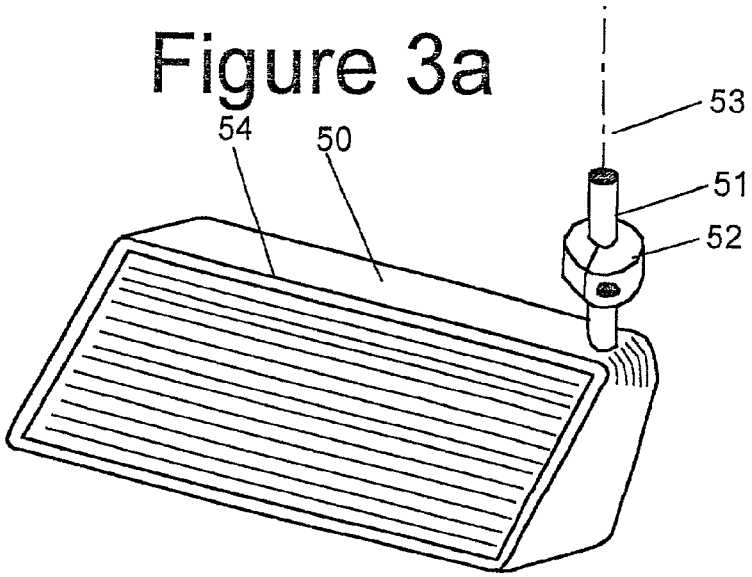
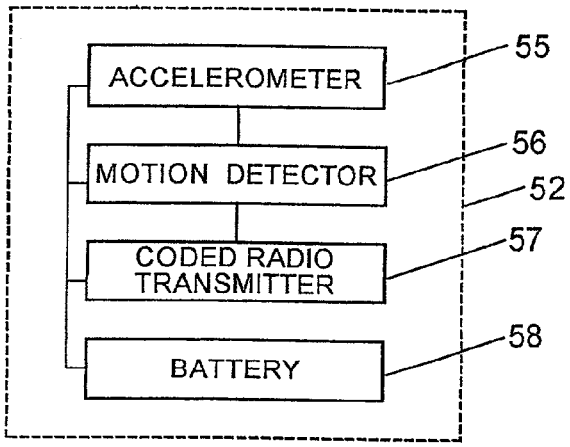
Figure 3b
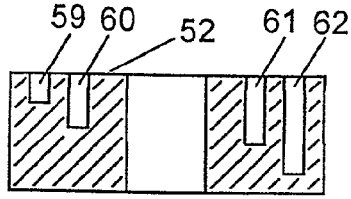
Figure 3c
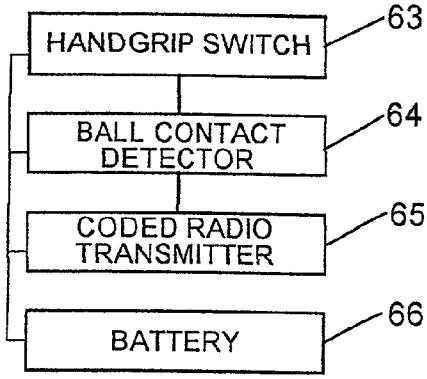
Figure 3d

RESORT HILLS COUNTRY CLUB

DAN E. GOLFER AUGUST 15, 2000

| HOLE | 1 | 2 | 3 | 4 | 5 | 6 | 7 | 8 | 9 | OUT |
|---|---|---|---|---|---|---|---|---|---|---|
| YARDS | 350 | 360 | 250 | 425 | 525 | 425 | 555 | 210 | 450 | 3,550 |
| PAR | 4 | 4 | 3 | 4 | 5 | 4 | 5 | 3 | 4 | 36 |
| SCORE | 5 | 5 | 4 | 6 | 5 | 5 | 6 | 4 | 4 | 44 |

| HOLE | 10 | 11 | 12 | 13 | 14 | 15 | 16 | 17 | 18 | IN |
|---|---|---|---|---|---|---|---|---|---|---|
| YARDS | 435 | 530 | 440 | 350 | 365 | 190 | 405 | 230 | 600 | 3,545 |
| PAR | 4 | 5 | 4 | 4 | 4 | 3 | 4 | 3 | 5 | 36 |
| SCORE | 4 | 7 | 5 | 4 | 4 | 3 | 5 | 4 | 6 | 42 |

X MARKS LOCATION OF STROKES

GOLF ROUND DATA SYSTEM WITH CELLULAR TELEPHONE AND PLAYER HELP FEATURES

FIELD OF THE INVENTION

The present invention relates to the game of golf, and more particularly to an improved golf round data system for collecting, storing, displaying and analyzing information both during play and after play is completed.

BACKGROUND

Golfers playing a game of golf try to maintain a consistent swing and adjust the distance the ball travels by choosing the correct club. They desire to choose the correct club to advance the ball toward the cup on a particular green without overshooting the green or putting the ball into a hazard area such as water, trees or a sand bunker. In order to accomplish this they need to know their present distance from the green and the expected result of applying their personal playing skill to each of the clubs they carry. They typically use their estimate of distances and recollection of past performance to choose a club which they think will safely advance the ball. Players often want to choose a club which limits the distance the ball will travel to keep it on the near side of a course hazard. Distances are not easy to estimate accurately and players sometimes choose a club which drives the ball too far and puts it beyond the target green or into a course hazard.

Accuracy is also not easy to estimate from memory. Players sometimes attempt to advance the ball to a position between course hazards when in reality their skill level makes a successful outcome unlikely. An important function of professional golf caddies is to offer players distance and game strategy advice to aid these distance and accuracy decisions. Players also desire to play continuously without being delayed by unusual slow players ahead of them on the course.

A previous golf round data system in U.S. Pat. No. 5,740,077 teaches a system which efficiently gives course distance information, collects shot accuracy and distance data with each of the player's clubs, paces play to discourage slow play, and displays performance data after the round is completed. It depends upon the player's memory of his past performance and skill to choose the correct club while playing. The previous golf round data system also needs some local external computer capability to load in course data before play, receive and process round data after play, and produce skill and performance information for the player. The golf round data system in 5,740,077 uses a special purpose unit which has no other function. It also requires the player to press a button to indicate that each stroke has been taken and data should be recorded. This earlier system does not let the player specify the intended direction of the next stroke.

A golf computer device in U.S. Pat. No. 5,507,485 teaches displaying the layout of the hole being played on a handheld graphical display but limits the displays to a series of predetermined scenes centered on the hole's fairway as play progresses.

OBJECTS AND ADVANTAGES

It is the object of the present invention to provide an improved golf round data system which eliminates the limitations of the previous system. Recent improvements in cellular telephones, the global positioning system, and graphical display are employed.

This new system can use a graphical display to show the player the probable distance and accuracy result of a stroke to be taken using a selected club and present skill level. The display shows the current hole being played, the current ball position, the intended direction of the next stroke, and the probable result area within which the ball can be expected to lie after a stroke taken with the selected club. If a course hazard is within the probable result area the player can adjust club selection or intended direction to obtain a more favorable result. As play on a hole progresses the display changes to show the features of the hole between the player's present position and the objective even if the player is outside the fairway. After reaching the green the display can aid putting by showing the forces tending to make the ball break from a straight line to the cup.

This invention also allows course layout information and past player performance data to be loaded into the hand-held unit via a cellular telephone call. The results of past rounds can also be shown directly on the graphical display. These features permit this new golf round data system to be used without access to a separate local computer. The combination with cellular telephone permits a hand-held unit with utility beyond the golf game. Since cellular phones will soon be required to have location capability to facilitate emergency calls it is relatively easy to include golf round data collection features in a hand-held cellular telephone.

The system also can automatically detect strokes taken and clubs used to collect round data without the player having to remember to do anything to make it happen. Each of a player's clubs can be equipped to emit a signal when they are used to stroke a ball and the new golf round data system hand-held unit receives, interprets and registers these signals. The player would still be responsible for entering penalty strokes since they do not have a club physically striking a ball.

A further feature of the new system is that after the round is complete the data can be uploaded to the player's unique file area on the Internet. This permits the player to access his or her golfing data and analyses of it from any Internet access point.

DRAWINGS

FIG. 1: Cellular Phone Handset With Graphic Golf Round Data Capability

Figure 2:
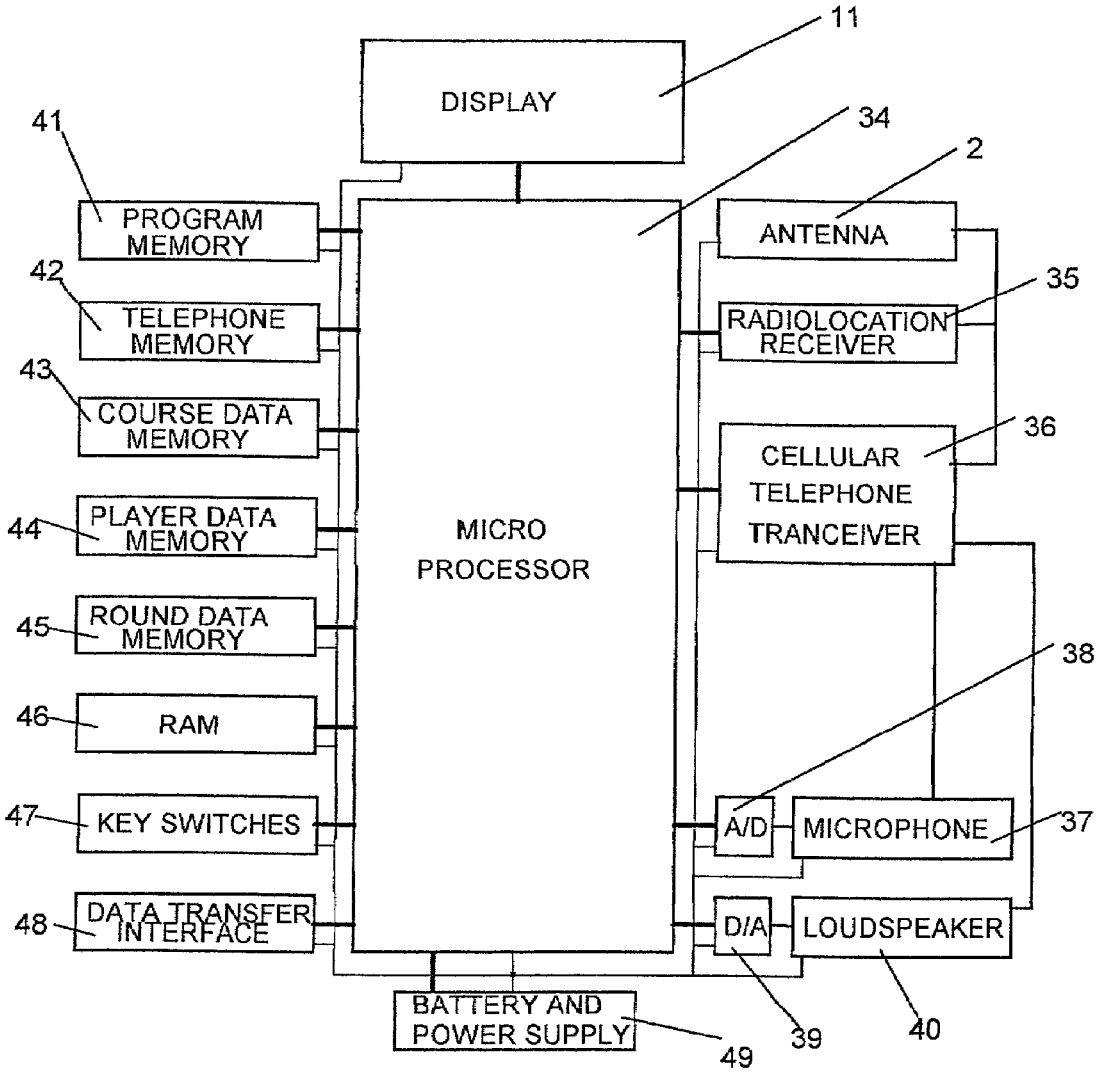

FIG. 2: Schematic Block Diagram of Components of Cellular Phone Handset With Graphic Golf Round Data Capability FIG. 3*a*: Telemetry Equipped Golf Club FIG. 3*b*: Schematic Block Diagram of Components of Radio Telemetry Unit FIG. 3*c*: Passive Telemetry Unit Cross Section FIG. 3*d*: Schematic Block Diagram of Components of Built-in Radio Telemetry Unit FIG. 4*a*: Graphic Display Prior to a Second Stroke on a Hole FIG. 4*b*: Graphic Display Prior to a Putt FIG. 5: A Souvenir Map of a Course and Round

DESCRIPTION

FIG. 1 shows a perspective view of a cellular phone handset with a graphic golf round data capability. The outer case 1 is of the type typical of a cellular handsets. It is lightweight, breakage resistant, and resistant to environmental effects. The antenna 2 converts cellular and radio location radio waves into electrical signals for processing by circuits inside the case 1. The antenna 2 also converts cellular phone signals into radio waves when the handset is transmitting. Speaker 3 and microphone 4 apertures in the case allow sound out and in. Contacts 5 on the outside of the case permit battery charging and serial data communication with other data handling devices. A conventional telephone keypad 6 is provided for entering telephone numbers. The send button 7 enables telephone numbers entered to be connected. The end button 8 is used to end calls and turn power on or off. The menu button 9 lets the user call up a main menu to select among the available operating modes of the handset. These modes can include phone, email, web, golf, GPS, golf/phone, and GPS/phone. These particular labels assume that the radio location system used is the Global Positioning System. The cursor button 10 allows the user to increment the cursor from one item to the next on the display 11. The increase button 12 lets the user increase the value of a cursor selected item and the decrease button 13 lets the user decrease the selected item. The ok button 14 allows the user to enter data and activate the chosen items and values displayed. Display 11 is shown as a standard 320 pixel by 240 pixel unit oriented 240 wide by 320 high.

The alphanumeric information for the user is along the edges of the display 11. The mode display 15 shows the current operating mode. In the example shown in FIG. 1 the mode is "PLAY GOLF". The identifying initials of the current user are shown at 16. The hole being played is shown at 17. The number at 18 is the minutes remaining to complete the present hole if the players are to maintain a course management prescribed schedule of play. The yards 19 from the player's present position 31 to the central area of the green 25 is displayed. The club 20 the player intends to use for the next stroke is shown. The number of strokes 21 already used on the hole is displayed.

The central portion of display 11 shows a graphical representation of the hole being played. Items shown are the tee box 22, the fairway boundary indicated by a dashed line 23, the putting green boundary indicated by a solid line 24, the location of the central portion of the green indicated by the plus mark 25, bunkers indicated by stippled regions 26, standing waters hazards indicated by the dashed area 27, flowing water hazard indicated by multiple lines 28, trees 29, out of bounds regions indicated by crosshatched area 30, the player's present position indicated by the x 31, the intended direction for the next stroke shown by the long-short dashed line 32, and the probable region the ball will land is shown by the dotted oval 33.

FIG. 2 shows a schematic block diagram of the operating components of the cellular telephone handset with graphic golf round data capability. The microprocessor 34 which can be any of several widely known and available integrated circuits executes instructions from the program memory 41, receives and transmits data, and manages the overall operation of the handset. The antenna 2 converts cellular telephone and radiolocation radio waves into electrical signals for the radio location receiver 35 and the cellular telephone transceiver 36. The radiolocation receiver 35 can be made from commercially available chip sets which process signals from the Global Positioning System; it could also be some other radio location receiver such as one based upon sensing the time delays to send signals between the handset and each of two different cellular towers.

The microphone 37 converts speech and other sounds into electrical signals which are amplified and coupled to the telephone transceiver 36 and the microprocessor 34. A/D converter 38 digitizes the analog signals and passes the digitized representation of the sound information to the microprocessor 34. The loudspeaker 40 is connected to the cellular telephone transceiver 36 to let the user hear phone messages and through D/A converter 39 to allow microprocessor 34 generated audible signals to the user. The D/A converter 39 converts digital signals from the microprocessor 34 into analog signals to drive the loudspeaker subsystem 40 which would typically contain a power amplifier and a electrical to acoustic transducer.

The program memory 41 retains the program instructions and would preferably be a non-volatile type such as flash memory, EPROM, EEPROM or battery backed RAM. The telephone I.D. memory 42 is also non-volatile and retains telephone number, serial number and account information necessary for the cellular system to recognize and connect to a particular handset. In practice memories 41 and 42 could in fact be combined within a single integrated circuit. Course data memory 43 retains golf course layout information used to generate graphical displays and alphanumeric data displays as a round of golf is played. The player data memory 44 retains information about one or more players' skill levels. This information is accumulated from previous rounds played by each user and loaded into the player data memory 44 prior to starting a round of play. The round data memory 45 retains data for all strokes taken by one or more players during a round of play. The stroke data for each stroke includes the location of the stroke, the club used, the hole being played, the time of the stroke, and the identity of the player making the stroke. The RAM random access memory 46 is the usual utility memory for variables and computations common to systems with microprocessors.

The key switches 47 are activated by the user operated buttons to allow user data inputs to the system. The data transfer interface 48 permits the handset to exchange data with one or more computers which retain the required databases. The interface could for example be a simple RS-232 standard serial port, an infrared optical link, an RF link such as the Bluetooth standard. The battery and power supply 49 stores enough energy to operate the handset for at least one round of golf and supplies electrical power to the other components of the handset.

FIG. 3-A shows a perspective view of the lower portion of a golf club equipped with a telemetry unit which sends data to the hand-held unit of FIG. 1. The club 50 is shown with a short portion of the club shaft 51. The telemetry unit 52 affixed to the shaft near its lower end as shown. The telemetry unit communicates to the hand held data unit of FIG. 1 the fact that a particular club is being used to make a stroke.

FIG. 3-B shows a schematic block diagram of the components of a radio telemetry version of telemetry unit 52. The accelerometer 55 detects club head motion which is perpendicular to both the top face edge 54 and the shaft centerline 53. That information is passed to the motion detector 56 which turns on the transmitter 57 to send a coded radio signal. The code number transmitted uniquely identifies the player and club being used since each individual telemetry unit 52 that is used on a golf course has its own unique preassigned identifying code. The battery 58 powers the telemetry unit 52. The transmission frequency of the transmitter 57 is chosen to match that of one of the several radio receivers in the handset shown in FIG. 1. These receiver frequencies include the radio location frequency, cellular frequency or frequencies and the frequency of any receiver in the data transfer interface 48.

FIG. 3*c* shows a cross section of a passive acoustic telemetry unit. The cross section plane contains line 53 and is parallel to line 54. Holes 59, 60, 61 and 62 each emit a whistle tone as the club is swung rapidly providing a strong airflow over their open ends. The pitch of each tone is determined by the length of each hole. Shorter holes emit higher pitch tones. The holes can be kept short enough to make all the tones above the human hearing tonal range and therefore inaudible. Any of up to three of the tones can be silenced by omitting its corresponding hole. This provides 15 unique tone pattern combinations allowing each club a player carries to be assigned its own tone pattern. The natural click sound when the club contacts the ball provides on acoustic signal indicating that a stroke has been taken. Microphone 37 and A/D converter 38 convey the tone patterns and clicks to the microprocessor 34 where the information is processed to determine that a stroke has been taken with a particular club. Short putts do not make enough sound to register automatically and are therefore entered manually by the player.

The telemetry versions in FIGS. 3*a*, 3*b* and 3*c* can be applied to existing golf clubs. If the Telemetry capability is built into clubs during their manufacture then tone generating holes like 59, 60, 61 and 62 can be placed in the club heads. Radio telemetry can also be efficiently built into clubs during their manufacturer. FIG. 3*d* shows a schematic block diagram of components of a built-in radio telemetry unit. The hand grip switch 63 detects that the player has gripped the club and activates the ball contact detector 64. The hand grip switch 63 can take any of several forms. It could be a simple pressure sensitive contact which completes a circuit; it could be a piezoelectric sensor and threshold detector; or it could be a piezoresistive sensor and threshold detector. The ball contact detector can be a microphone embedded in the club head, an accelerometer in the club head, or a piezoelectric or piezoresistive surface on the club face. When the ball contact detector 64 detects ball contact it activates the coded radio transmitter 65 which is like 57. The battery 66 can be conveniently mounted inside the club handle where it is easy to replace and can also be reasonably large without significantly changing the player's swing motion.

OPERATION

Before the hand-held unit in FIG. 1 can be used it must be loaded with course and player specific information. If an analog or digital cellular telephone connection is available then the player dials a predetermined telephone number. Based upon the location of the hand-held unit as determined by its radio location capability the player receives a list of nearby golf courses. If he or she happens to be near the clubhouse of a golf course the list consists of the courses served by that clubhouse. If the player is not near a course clubhouse he or she of receives an alphabetical list of nearby courses with a "more selections" line at the bottom a list to permit the list to be expanded until the desired course is found. Allowing for an expanded list of the golf courses permits the user to preload the hand-held unit at any time before play is to begin. This capability is particularly useful if cellular coverage does not extend to the golf course to be played. Selecting the desired course starts the course data download. Course data consists of tee and green locations measured in the geographic coordinates used by the radiolocation capability of the hand-held unit. If the hand-held unit has a graphical display then course information also includes a course map containing the features to be displayed for each hole. The player then enters or his or her identity to start a download of player specific data. If the display 11 does not include a graphics capability the player specific data is the mean distance achieved with each club in past play. If display 11 can show a graphic representation of each hole being played then a the player specific data includes the lengths and widths of the elliptical patterns 33 containing 50% of the results of previous shots taken with each of the player's clubs, omitting the putter. If adequate past playing statistics for a golfer are not available then statistics for a player of average skill are entered. Any telemetry codes that identify the player's telemetry equipped clubs are also downloaded. If a hand-held unit is to be used by more than one player then player specific information for the other players who will use the unit is also downloaded.

If course management desires to use it, the two way communication capability can be used to assign a tee time when play is to begin at the first tee, set whether the distance information display 19, 33 is on or off, set whether or not distances are to be displayed on the hand-held unit if it is near the center of the green, set whether the pacing timer 18 is on or off, and collect payment of green and cart rental fees. Complete blanking of the distance display would be necessary for the remaining features of the system to be used in tournament play since the normal rules of golf prohibit the use of range finding devices in such play.

If the cellular capability is unavailable then data is transferred using the data transfer interface 48. The data transfer interface 48 connects to some device such as a personal computer and downloads the same information as above from a local database or from remote central database. The remote central database can be maintained on an Internet site.

After the data has been transferred to the hand-held unit the player display 16 shows identifying initials for the first player entered into the hand-held unit's memory, the hole number display 17 shows 0 because no hole has begun yet, the time display shows the minutes remaining until tee time for the starting tee, the distance display 19 shows the distance to the starting tee if it is less than 1000 yards, the club display 20 is blank as is the stroke count display 21. If the time remaining until tee time exceeds 60 minutes then the time remaining display shows hours and minutes remaining separated by a colon. The distance display goes blank if there is insufficient received radio signal strength to produce an accurate measurement of position. This feature alerts the user to the need to reposition the hand-held unit.

On heavy course usage days which are typically weekend days with pleasant weather slow play is a problem for course management. To combat slow play the pacing feature has been incorporated in this invention. When it is active the time remaining display 18 on the hand-held unit shows the time remaining to play out the present hole and get to the next tee. For most players this gentle reminder would be sufficient to cause them to keep up their play pace adequately and not, for example, consume too much time hunting a hopelessly lost ball. However, the management can also use the time remaining display to make rules prohibiting slow play if that is necessary. There could be a busy course rule for example which states that a playing group loses its tee time on any hole if the fairway in front is clear and they have not left the tee before the next following group's tee time for that hole. The slow players would then have to stand aside and let the impeded following group play through and try to fit themselves into the following player stream or skip that hole and go to the next. Since the hand-held unit records the locations of all player groups on the course as they make strokes and the times at which they were there, it would be possible for management to identify habitual slow players and prohibit them from playing on busy days. A scheduled intermission feature between holes 9 and 10 recognizes the fact that courses are usually laid out to bring the players back so the clubhouse between holes 9 and 10. On hot days they are likely to appreciate a lengthened cooling break for refreshment. The time to the next tee display 18 provides an easy and convenient way for players to take a break without impeding play. Management in scheduling the pacing feature simply adds the desired break time to the scheduled time to play hole number 9. The scheduled break between holes 9 and 10 also puts some slack in the playing schedule to allow slower players to get back on time.

The distance displayed 19 is the distance from the present location to the next objective on the course. The radiolocation receiver 35 and microcomputer 34 determine the present location of the hand-held unit on the course. The location of the desired course objective has previously been stored in the hand-held unit memory. The microcomputer 34 in the hand-held unit uses this information in conjunction with its program instructions to compute the distance between the two points in a manner well known by those skilled in the art. In the interests of speeding play course management may choose to activate the close to the pin feature which causes the distance display to show "<20" when the hand-held unit is less than 20 yards from the center of the green. This feature reduces distractions for players when they are close enough to the pin to clearly judge distances for themselves and are likely playing putting strokes.

The next club display 20 designates the numbered driver clubs as a number followed by a lower case letter d, the numbered iron clubs by a numeral followed by a lower case letter i, and the unnumbered clubs by two upper case letters such as P for the putter, PW for the pitching wedge, and SW for the sand wedge.

When the time display 18 goes to zero indicating that tee time for the starting tee has arrived the hole number display 17 changes to the number of the starting tee. The distance display 19 shows the distance to the corresponding green. It sometimes happens that players begin on hole 10 rather than 1 if for example they are going to play only 9 holes or there is course maintenance in progress on holes 1 through 9. The next club display 20 shows the club which the player identified by the player initial 16 would typically use if that player's previous club use statistics have been entered into hand-held unit player data memory 44. In the absence of statistics for a particular player the next club display would show the club which would be used by an average player. The stroke display shows a 0 because no strokes have yet been consumed on the hole. At this point in the use cycle the next club display 20 is blinking to indicate that it can be changed by the player by using the increase button 12 or the decrease button 13 on the hand-held unit. The player can also use the cursor button 10 to select which display item blinks and can be changed by the increase or decrease buttons 12 and 13. Each press of the cursor button 10 moves the blinking location sequentially among the items which the player can control. These are the next club to be used 20, the intended direction line 32 for the next stroke, hole number being played 17, player identity 16 if multiple players are sharing a hand-held unit, and strokes used on the hole 21. The next club display 20 blinks and can be changed at will by the player who is about to strike the ball from the tee. The player increases or decreases the club display 20 until it shows the club selected by the player for the stroke. For each club the probable result 33 is shown. If the display is non-graphic showing only alphanumeric characters then the average distance for the selected club would show momentarily on the distance display until the increase or decrease button is released. Since the display already shows a club close to the appropriate one, the number of increases or decreases to make the display match the club intended is small. One press on cursor button 10 then moves the blinking to the intended direction line 32 for the stroke about to be taken. When the line 32 is blinking pressing button 12 shifts line 32 to the left; pressing button 13 shifts line 32 to the right. While at the location of the first stroke, the player presses the OK button 14 to record in hand-held unit memory 45 the fact that a stroke has been used, the club displayed by 20, the radio location position on the course at which the stroke was taken, the intended direction 32, and the time at which the stroke was taken. The first stroke will be in a course tee area for the first hole to be played but these are typically fairly long to allow players of different abilities to play the course comfortably by using one of three or more tee locations usually designated in order of increasing distance from the pin as ladies', men's, and professional. For this reason it is necessary for the locations of tee strokes as well as the other strokes in a round to have their positions recorded.

If the player is using telemetry equipped golf clubs as shown in FIG. 3*a*–3*d* adapted to work with the hand-held unit then nearly all strokes and clubs are automatically registered. Some short putts may be so soft as to be undetectable by the telemetry and still have to be registered manually by pressing OK button 14. For most strokes the player then simply edits the intended direction 32 if it is not toward the center of the green 25, enters penalty strokes, and corrects any erroneously registered strokes.

After a stroke is registered automatically or by pressing the OK button 14 the display changes in one of two ways depending upon whether the hand-held unit is being used by a single or multiple players. If a single player is using it then after a stroke is recorded the stroke display 21 increments by one and blinks to allow the player to easily use the increase button 12 to register a penalty stroke if one should be called for by the results of the stroke just previously registered. The club display 20 shows the club just previously recorded for the stroke. The direction line 32 shows the intended direction just previously recorded for the stroke. In the event that the player pressed the OK button 14 in error without actually taking a stroke or recorded a club or intended direction not actually used the stroke can be canceled by decreasing the stroke count display 21 by one using the decrease button 13 and a message is shown on display 11 in place of part of the graphical display. That message is "Canceling last stroke also erases its lie, intended direction, and club—press CURSOR to proceed." The message remains displayed until it is acknowledged by the player pressing the cursor button 10. Whether or not the previous stroke has been canceled, after cursor button 10 is pressed the display returns to its original configuration ready to register a stroke. The display window 11 shows player identity 16, hole being played 17, minutes remaining to get to the next hole tee 18, yards 19 to the center of the green of the hole being played, next club 20 selected (flashing), and strokes used on the present hole so far 21. The direction line 32 extends from the present position 31 to the center of the green 25. If the player using the hand-held unit singly does not press any buttons after registering a stroke and moves more than 10 yards from the lie recorded the display reverts to the numerical configuration with the approximate club to be used next 20 blinking. After play for a hole is complete and the hand-held unit leaves the vicinity of the green and is transported to near the tee for the next hole, the hole number 17 advances to the next hole number to be played and time display 18 changes to the time remaining to complete that next hole. Hand-held unit travel from a green to the next tee area is easily detectable by the microcomputer in the hand-held unit since the radiolocation system continually updates its present position data and the locations of greens and tee areas have been previously stored in the hand-held unit memory. Thus a player using a hand-held unit by himself without telemetry equipped clubs ordinarily would simply change the club display and direction displays 20,32 and press the OK button 14 as the round is played. With telemetry equipped clubs the player would not need to change the club display 20 and would rarely need to press the OK 14 button to correctly register strokes.

Figure 4A:
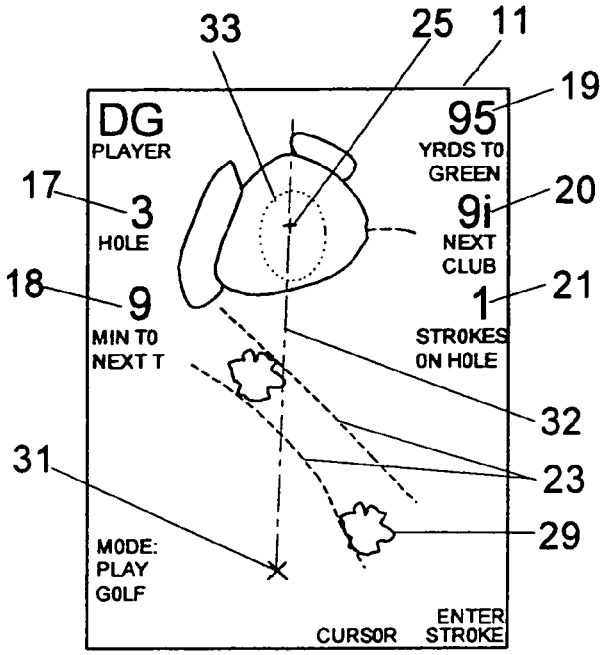

After each stroke on a hole the player moves to the ball's new location and the graphical display 11 changes as shown in FIG. 4*a*. The display shows the portion of the golf course between the player's position 31 and the green 25. In the particular example shown in FIG. 4*a* the player is in an adjacent fairway while playing hole number 3 shown on hole display 17, has 9 minutes remaining to complete the hole as shown on the time display 18, is 95 yards from the middle of the green as shown on the distance display 19, has chosen to use a nine iron as shown by the next club display 20, has a 50% probability that the ball will land within contour 33, and has previously used one stroke on the hole as shown on the stroke display 21.

Figure 4B:
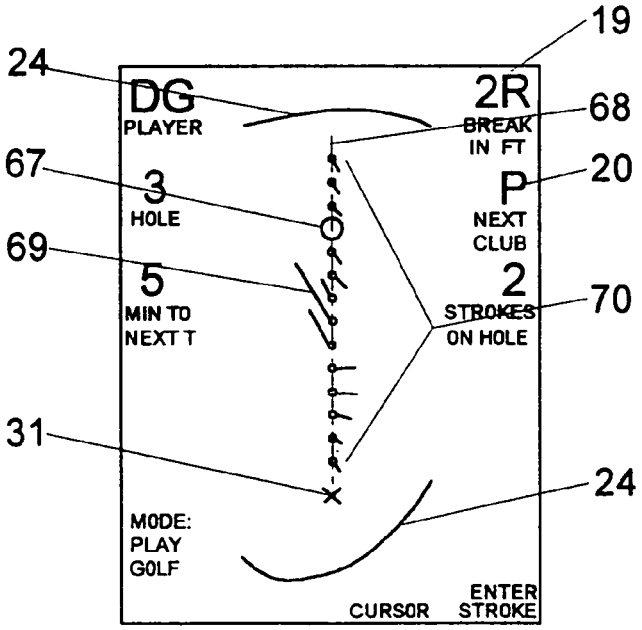

When the player reaches the green the display changes as shown in FIG. 4*b*. Shown on the display are the edge of the green 24, the player's location 31, the cup 67, and a straight line 68, between the player and the cup. The contour of the green and the grain of the grass impose forces on the ball tending to slow or speed it and tending to make it break from the ideal straight line 68. Those forces pushing on the ball are displayed as lines 70 toward successive possible ball positions along line 68. The length of each line toward a ball position is proportional to the magnitude of the force at that position on the green. The direction of lines 70 indicate the direction of the force pressing on the ball at each position. In the particular example in FIG. 4*b* the ball traveling along line 68 would experience a small accelerating force with a break toward the left at all places except at and immediately before and after position 69. At position 69 the ball experiences a retarding force and a significant break to the right due to a transition up a short incline to a higher level near the cup. The distance display 19 shows an estimate of the distance the putt will break left or right from a straight line between the player's position and the cup. In the particular example shown in FIG. 4*b* the handheld unit has estimated from the green contour and position data that the putt will break 2 feet to the right.

If multiple players are sharing a hand-held unit then after a stroke is registered by pressing the OK button 14 the display changes to show the stroke count 21 increased by one and no display elements blinking for an interval of about 5 seconds. After the 5 second interval for the first player to see what has been registered the displayed player initials 16 change to those for another player and blink. If the player designated is the next to take a stroke then that player simply moves to his or her ball, presses the cursor button 10 to make the next club display 20 blink, adjusts the club display to the club chosen using the increase 12 or decrease 13 button, presses cursor button 10 to make the direction line 32 blink, moves the line display with increase 12 or decrease 13 buttons, and registers a stroke by pressing the OK button. Thus it is seen that two players can share a hand-held unit with nearly the same ease of operation as a single player. Four players sharing a hand-held unit would easily use the increase 12 or decrease 13 buttons to select the correct player initials before each stroke. Yet at any time the cursor button 10 and increase 12 and decrease 13 buttons can be used to correct the displayed club, stroke count, and hole number for any of the players.

If no button is pressed within 15 minutes since the last button press then the hand-held unit automatically records it's present position in memory to facilitate slow play detection.

At any time there are two other hand held unit golf operating modes in addition to PLAY which players can access by pressing menu button 9, the cursor button 10 to move the cursor to golf, the OK button 14 to select golf and make the display show the three available golf modes which are named PLAY, CARD and SHOW. A golf mode is selected using the cursor 10 and OK 14 buttons. PLAY is the round data collection playing mode described above. The CARD mode causes the display to show a player's score card for the round up to the present hole. The SHOW mode displays previous strokes taken during a round. To show previous stroke the hand-held units' buttons are used to set the hole number 17 and the stroke number 21. The graphical display then shows a line extending from the location where the stroke was taken to the location of the next stroke. The club display 20 shows the club used for that particular stroke. The direction display line 32 shows the stroke's intended direction. The distance display 19 shows the distance achieved with the caption changed from "YRDS TO GREEN" to simply "YARDS". If the stroke was the final stroke on a hole then an X shows the location of that final stroke without any direction or distance information display. This SHOW mode lets a player review any previous stoke in a round or replay the entire round if that is desired.

Figure 5:
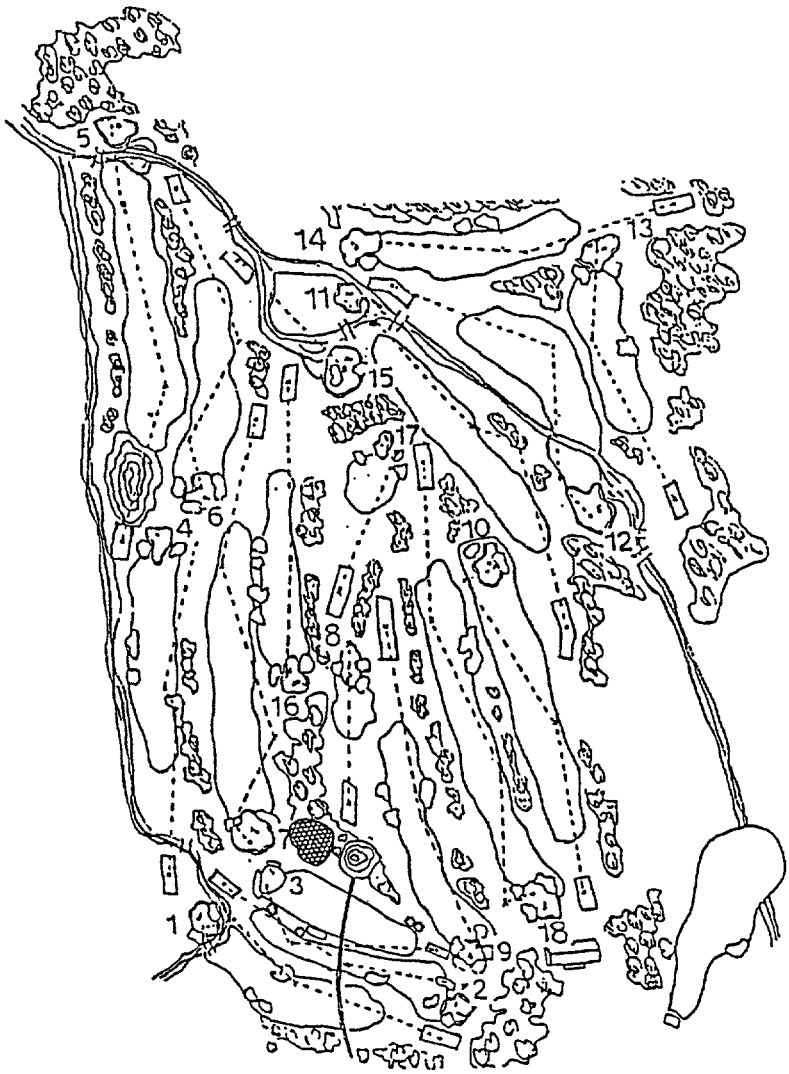

After play for a round is finished the data collected for each player using a hand-held unit is up loaded to a database. The database contains information on previous rounds played by each player and is the source of information about player performance. The database can be maintained on a local computer, at some remote central site preferably accessible by the Internet, or copies of the database can be maintained at both local and remote central locations. If the cellular telephone service is available the upload data transfer can be accomplished by dialing a predetermined telephone number to establish a connection with the computer maintaining the player's database. Alternatively the data transfer interface 48 can be used to connect with a local computer. Data transferred to a local computer can be entered into a locally maintained database for the player and/or forwarded onto the player's remote central database.

Where ever the database is maintained, several outputs can be generated from it. The database contains the identity of the player and the course, the location of each stroke taken during a round, and the data and time of play. For any particular round a souvenir plot of the course and the path of the strokes taken by the player can be printed along with a scorecard as shown in FIG. 5. Certificates commemorating special events such as a hole-in-one, handicap reduction, or other significant improvement can be printed. Past play data allows each player's performance to be analyzed. The distance and directional accuracy of each stoke taken with each club can be computed from the ball position data stored. From these data the probable result contour 33 for each club can be computed for a player. The player's skills in separate portions of the game such as driving, approach shots, sand trap strokes, and putting can be compared with averages for players of similar skill level to determine which portion should be worked on first to gain improvement in game scores.

Conclusion and Scope

From the above description it is seen that the present invention is a significant improvement over the previous golf round data system. It collects more accuracy data, presents it to the player more conveniently, takes advantage of cellular telephone capabilities, does not necessarily need equipment installation at the golf course, and makes the resulting data easily accessible to the player anywhere there is Internet access.

The particular embodiment described above is not the only possible configuration of this invention. For example, the monochrome graphic display described could be changed to a multicolor unit to use colored regions in place of lines to designate course areas. The probable result display could be shown as a rectangle rather than an ellipse; or the probable result could be shown as a scatter plot displaying the range and accuracy of previous strokes taken with the chosen club. The displayed objective on the green could be the cup rather than the center of the green surface. The hand-held unit could be made smaller and less expensive by substituting an alphanumeric display for the graphic display described, and the device would still be a significant improvement over the previous art. The cellular feature could be omitted for hand-held units which are always to be used at a course equipped with local data transfer capability, and they would cost less and serve the players just as well. The collected round data could be maintained on some other easily accessible data repository instead of the Internet web site described. Accordingly, the scope of the invention should be determined not by the particular embodiment illustrated, but by the appended claims and their legal equivalents.

What is claimed is:

1. A portable golf round data system comprising:

(a) a radiolocation receiver to receive at least one external locating signal from which a user's current location on a golf course can be determined;

(b) data storage in a data collection unit for storing golf course data relating to locations of one or more golf course features;

(c) at least one processor in said data collection unit operatively connected to said radiolocation receiver and to said data storage, said processor programmed to:

1) determine said user's current location on said golf course from said external locating signal;

2) determine a probable landing area of a golf ball as a result of the next stroke, said probable landing area comprising an area in which the golf ball is expected to land with a specified probability;

3) dynamically generate a graphical view of a selected portion of said golf course based on said user's current location and said golf course data, said dynamically generated view including a selected portion of the golf course and a visual indication representing the probable landing area of the golf ball; and (d) a graphic display to display said graphical view of said selected portion of said golf course.

2. The system of claim 1 wherein said course data is transferred to said data collection unit via a wireless communication link.

3. The portable golf round data system of claim 2 wherein the wireless communication link is a cellular telephone data channel.

4. The system of claim 1 wherein said course data is transferred to said data collection unit by a connection to a data processor external to said data collection unit.

5. The system of claim 1 wherein said course data is transferred to said data collection unit from a data file accessible via the Internet.

6. The system of claim 1 wherein said course data is transferred to said data collection unit by installing removable data memory media to said data collection unit.

7. The golf round data system of claim 1 wherein said dynamically generated view is from the current location of the user.

8. The system of claim 1 wherein said data storage further contains data relating to a predetermined skill level.

9. The portable golf round data system of claim 8 wherein said predetermined skill level is based upon the user's past performance skill level.

10. The portable golf round data system of claim 1 wherein said graphic display is adapted to show the time remaining to complete some selected portion of a golf round.

11. The portable golf round data system of claim 1 wherein said graphic display is adapted to show the number of the hole currently being played.

12. The portable golf round data system of claim 1 further including a stroke register to register each stroke taken by a user.

13. The portable golf round data system of claim 12 wherein said stroke register includes a manually actuated switch contact.

14. The system of claim 12 wherein said processor is further adapted for voice recognition of at least one selected word.

15. The portable golf round data system of claim 12 further including stroke data storage for storing location data for each stroke taken until said data can be subsequently retrieved for further analysis or long term storage.

16. The portable golf round data system of claim 15 wherein said graphic display is adapted to show the location of at least one selected previous stroke in said stroke data storage and the resulting ball position after said stroke.

17. The system of claim 15 wherein said location data is transferred from said data collection unit to a data processor external to said data collection unit.

18. The system of claim 17 wherein said data processor includes means for generating a golf course plot with the location of all recorded strokes.

19. The portable golf round data system of claim 17 wherein said data processor further includes means for printing commemorative certificates for predetermined events.

20. The system of claim 15 wherein said location data is transferred from said data collection unit to a data file accessible via the Internet.

21. The system of claim 15 wherein said location data is transferred from the said data collection unit via a wireless communication link.

22. The portable golf round data system of claim 21 wherein the wireless communication link is a cellular telephone data channel.

23. The system of claim 12 wherein said graphic display is adapted to show the number of strokes said user has used on the current hole being played.

24. The portable golf round data system of claim 12 wherein said graphic display is adapted to show a score card with the number of strokes used on each hole completed and the total used on the round.

25. The system of claim 1 wherein said processor is further adapted to receive and recognize telemetry signals emitted by telemetry equipped golf clubs.

26. The portable golf round data system of claim 25 wherein said telemetry signals include sounds emitted by a telemetry equipped club when a stroke is taken with said club.

27. The portable golf round data system of claim 25 wherein said telemetry signals include radio signals emitted by a telemetry equipped club when a stroke is taken with said club.

28. The system of claim 1 wherein said graphical view includes a plurality of said golf course features of said golf course.

29. The golf round data system of claim 1 wherein said graphical view includes an indication of the user's current location.

30. The golf round data system of claim 1 wherein said dynamically generated view is from the vantage point of the user.

31. The golf round data system of claim 1 wherein the visual indication of the probable landing area is a closed geometric figure encompassing an area in which a defined percentage of shots is likely to land.

32. A cellular radiotelephone comprising:

(a) a cellular radio transceiver to communicate with a cellular network;

(b) a radiolocation receiver for receiving at least one external locating signal from which a user's current location on a golf course can be determined;

(c) data storage operatively connected to said cellular radio transceiver for storing golf course data relating to the location of-at least one golf course feature, wherein at least a portion of said golf course data is received via said cellular network from said cellular radio transceiver;

(d) a processor to perform calculations based on said user's current location and said stored golf course data to dynamically generate a graphic representation of a selected portion of the golf course including a visual representation of the probable landing area of the golf ball due to the next stoke, wherein said probable landing area comprises an area in which the golf ball is expected to land with a specified probability; and (e) a display to display said graphic representation.

33. The cellular radiotelephone of claim 32 wherein said display is adapted to show the club the user intends to use for the next stroke.

34. The cellular radiotelephone of claim 32 wherein said data storage further contains data relating to said user's past performance.

35. The cellular radiotelephone of claim 32 wherein said display is adapted to show the time remaining to complete some selected portion of a golf round.

36. The cellular radiotelephone of claim 32 wherein said display is adapted to show the number of the hole currently being played.

37. The cellular radiotelephone of claim 32 further including a stroke register to register each stroke taken by a user.

38. The cellular radiotelephone of claim 37 further including stroke data storage for storing location data for each stroke taken until said data can be subsequently retrieved for further analysis or long term storage.

39. The cellular radiotelephone of claim 37 wherein said stroke register includes a manually actuated switch contact.

40. The cellular radiotelephone of claim 37 wherein said data processor is further adapted for voice recognition of at least one selected word.

41. The cellular radiotelephone of claim 38 wherein said stroke data is transferred from the said cellular radiotelephone to a remote computer via a cellular telephone data channel.

42. The cellular radiotelephone of claim 38 wherein said stroke data is transferred from said cellular radiotelephone to a data processor external to said cellular radiotelephone.

43. The cellular radiotelephone of claim 42 wherein said data processor further includes means for generating a golf course plot with the location of all recorded strokes.

44. The cellular radiotelephone of claim 42 wherein said data processor further includes means for printing commemorative certificates for specified events.

45. The cellular radiotelephone of claim 38 wherein said stroke data is transferred from said cellular radiotelephone to a data file accessible via the Internet.

46. The cellular radiotelephone of claim 32 wherein said display is adapted to show the number of strokes a user has used on the current hole being played.

47. The cellular radiotelephone of claim 32 wherein said data processor is further adapted to receive and recognize telemetry signals emitted by telemetry equipped golf clubs.

48. The cellular radiotelephone of claim 47 wherein said telemetry signals include sounds emitted by a telemetry equipped club when a stroke is taken with said club.

49. The cellular radiotelephone of claim 47 wherein said telemetry signals include radio signals emitted by a telemetry equipped club when a stroke is taken with said club.

50. The cellular radiotelephone of claim 32 wherein said display is adapted to show a user the probable distance a ball will travel when struck by a selected club.

51. The cellular radiotelephone of claim 32 wherein said display gives a visual indication of the amount and direction that the golf ball will break on the next putt.

52. The cellular radiotelephone of claim 32 wherein said data processor is external to said cellular radiotelephone and said data processor is operatively connected to said cellular radiotelephone through wireless data transfer.

53. The cellular radiotelephone of claim 32 wherein at least a portion of said data storage is external to said cellular radiotelephone.

54. The cellular radiotelephone of claim 32 wherein a user's data is uploaded via said cellular network and said cellular radio transceiver.

55. The cellular radiotelephone of claim 32 wherein the display shows the distance from the user's current location to the green.

56. The cellular radiotelephone of claim 32 wherein the graphic representation includes at least a portion of the green.

57. The golf round data system of claim 32 wherein the visual indication of the probable landing area is a closed geometric figure encompassing an area in which a defined percentage of shots is likely to land.

58. A portable golf round data system comprising:

(a) a radiolocation receiver to receive at least one external locating signal from which a user's current location on a golf course can be determined;

(b) data storage in a data collection unit for storing course data relating to locations of one or more golf course features;

(c) at least one processor in said data collection unit operatively connected to said radiolocation receiver and to said data storage, said processor programmed to:

1) determine said user's current location on a green of said golf course from said external locating signal; and 2) dynamically generate a graphical view of a selected portion of said green including the users current position on the green, the cup on the green, and a representation of the forces on a ball along a line between the user's current position and the cup; and (d) a graphic display to display said graphical view of said selected portion of said golf course.

59. The portable golf round data system of claim 58 wherein the forces are represented graphically on said display.

60. The system of claim 59 wherein said processor is further adapted to receive and recognize telemetry signals emitted by telemetry equipped golf clubs.

61. The cellular radiotelephone of claim 59 wherein said display is adapted to show the club the user intends to use for the next stroke.

62. A portable golf round data system comprising:

(a) a radiolocation receiver to receive at least one external locating signal from which a user's current location on a golf course can be determined;

(b) data storage in a data collection unit for storing course data relating to locations of one or more golf course features;

(c) at least one processor in said data collection unit operatively connected to said radiolocation receiver and to said data storage, said processor programmed to:

1) determine said user's current location on said golf course from said external locating signal; and 2) dynamically generate a graphical view of a selected portion of said golf course based on said user's current location, said dynamically generated view including a selected portion of the course and graphic indica representing the intended path or direction of the golf ball as a result of the next stroke; and (d) a graphic display to display said graphical view of said selected portion of said golf course.

63. The portable golf round data system of claim 62 wherein said graphic display is adapted to show the number of the hole currently being played.

64. The portable golf round data system of claim 62 further including a stroke register to register each stroke taken by a user.

65. The portable golf round data system of claim 62 further including stroke data storage for storing location data for each stroke taken until said data can be subsequently retrieved for further analysis or long term storage.

66. The system of claim 65 wherein said location data is transferred from said data collection unit to a data file accessible via the Internet.

67. The system of claim 62 wherein said graphic display is adapted to show the number of strokes said user has used on the current hole being played.

68. A portable golf round data system comprising:

(a) a radiolocation receiver to receive at least one external locating signal from which a user's current location on a golf course can be determined;

(b) data storage in a data collection unit for storing course data relating to locations of one or more golf course features;

(c) at least one processor in said data collection unit operatively connected to said radiolocation receiver and to said data storage, said processor programmed to:

1) determine said user's current location on a green on said golf course from said external locating signal; and 2) dynamically generate a graphical view of a selected portion of said green; and (d) a graphic display to display said graphical view of said green and a visual indication of the amount and direction that the golf ball will break on the next putt.

69. A cellular radiotelephone comprising:

(a) a cellular radio transceiver to communicate with a cellular network;

(b) a radiolocation receiver for receiving at least one external locating signal from which a user's current location on a golf course can be determined;

(c) data storage operatively connected to said cellular radio transceiver for storing golf course data relating to at least one golf course feature, wherein at least a portion of said golf course data is received via said cellular network from said cellular radio transceiver;

(d) a processor to perform calculations based on said user's current location and said stored golf course data to dynamically generate a graphic representation of a selected portion of the golf course including graphic indicia representing the intended path or direction of a golf ball due to the next stroke; and (e) a display to display said graphic representation.

70. The portable golf round data system of claim 69 wherein said graphic display is adapted to show the number of the hole currently being played.

71. The portable golf round data system of claim 69 further including a stroke register to register each stroke taken by a user.

72. The portable golf round data system of claim 69 further including stroke data storage for storing location data for each stroke taken until said data can be subsequently retrieved for further analysis or long term storage.

73. The system of claim 72 wherein said location data is transferred from said data collection unit to a data file accessible via the Internet.

74. The system of claim 69 wherein said graphic display is adapted to show the number of strokes said user has used on the current hole being played.

75. The system of claim 69 wherein said processor is further adapted to receive and recognize telemetry signals emitted by telemetry equipped golf clubs.

76. The cellular radiotelephone of claim 69 wherein said display is adapted to show the club the user intends to use for the next stroke.

77. A cellular radiotelephone comprising:

(a) a cellular radio transceiver to communicate with a cellular network;

(b) a radiolocation receiver for receiving at least one external locating signal from which a user's current location on a green on a golf course can be determined;

(c) data storage operatively connected to said cellular radio transceiver for storing golf course data relating to at least one golf course feature, wherein at least a portion of said golf course data is received via said cellular network from said cellular radio transceiver;

(d) a processor to perform calculations based on said user's current location on said green and said stored golf course data to dynamically generate a graphic representation of a selected portion of said green and a visual indication representing the forces on the ball; and (e) a display to display said graphic representation.

78. A cellular radiotelephone comprising:

(a) a cellular radio transceiver to communicate with a cellular network;

(b) a radiolocation receiver for receiving at least one external locating signal from which a user's current location on a green on a golf course can be determined;

(c) data storage operatively connected to said cellular radio transceiver for storing golf course data relating to at least one golf course feature, wherein at least a portion of said golf course data is received via said cellular network from said cellular radio transceiver;

(d) a processor to perform calculations based on said user's current location on said green and said stored golf course data to dynamically generate a graphic representation of a selected portion of said green; and (e) a display to display said graphic representation and a visual indication of the amount and direction that a golf ball will break on the next putt.

* * * * *